US005853567A

United States Patent [19]

Gouzien et al.

[11] Patent Number: 5,853,567

[45] Date of Patent: Dec. 29, 1998

[54] METHODS AND APPARATUS FOR THE VISCOSITY REDUCTION OF HEAVY HYDROCARBON FEEDSTOCKS

[75] Inventors: Luc Gouzien, Le Havre; Elisabeth Mouchot, Etoutteville; Pierre Lutran, Vincennes; Marc Persing, St. Andresse, all of France

[73] Assignee: Total Raffinage Distribution, S.A., Puteaux, France

[21] Appl. No.: 759,520

[22] Filed: Dec. 4, 1996

[30] Foreign Application Priority Data

Dec. 4, 1995 [FR] France ..... 95 14313

[51] Int. Cl.[6] ..... C10G 9/14; C10G 9/18; F28D 7/00

[52] U.S. Cl. ..... 208/132; 208/131; 208/106; 422/134; 422/228; 422/236; 196/110; 196/111; 196/116

[58] Field of Search ..... 422/134, 228, 422/236; 196/110, 111, 116; 208/131, 132, 106, 128

[56] References Cited

U.S. PATENT DOCUMENTS 4,247,387 1/1981 Akbar ..... 208/106
4,443,328 4/1984 Sakurai et al. ..... 208/106
4,551,233 11/1985 Blauwhoff et al. ..... 208/106

FOREIGN PATENT DOCUMENTS

A-007 656 6/1980 European Pat. Off. .
A-0 138 247 4/1985 European Pat. Off. .

*Primary Examiner*—Bekir L. Yildirim
*Attorney, Agent, or Firm*—Frommer Lawrence & Haug LLP; A. Thomas S. Safford

[57] ABSTRACT

A method for reducing the viscosity of a liquid heavy hydrocarbon feedstock comprising the steps of bringing said feedstock to a temperature capable of cracking of at least a portion of the hydrocarbons present in said feedstock and introducing said feedstock into a bottom portion of a maturation device (i.e. a "soaker"), where the feedstock is displaced from the bottom upwards, to get evacuated from a top portion of the soaker towards a fractioning unit. The invention also relates to an apparatus comprising a soaker in which are located, transversely to the direction of displacement of the feedstock to be treated, a plurality of annular discs spaced apart from one another, each disc comprising a circular central passage substantially coaxial to the soaker, the treated feedstock circulating from the bottom portion upwards in the soaker through the central passages of the various annular discs.

23 Claims, 1 Drawing Sheet

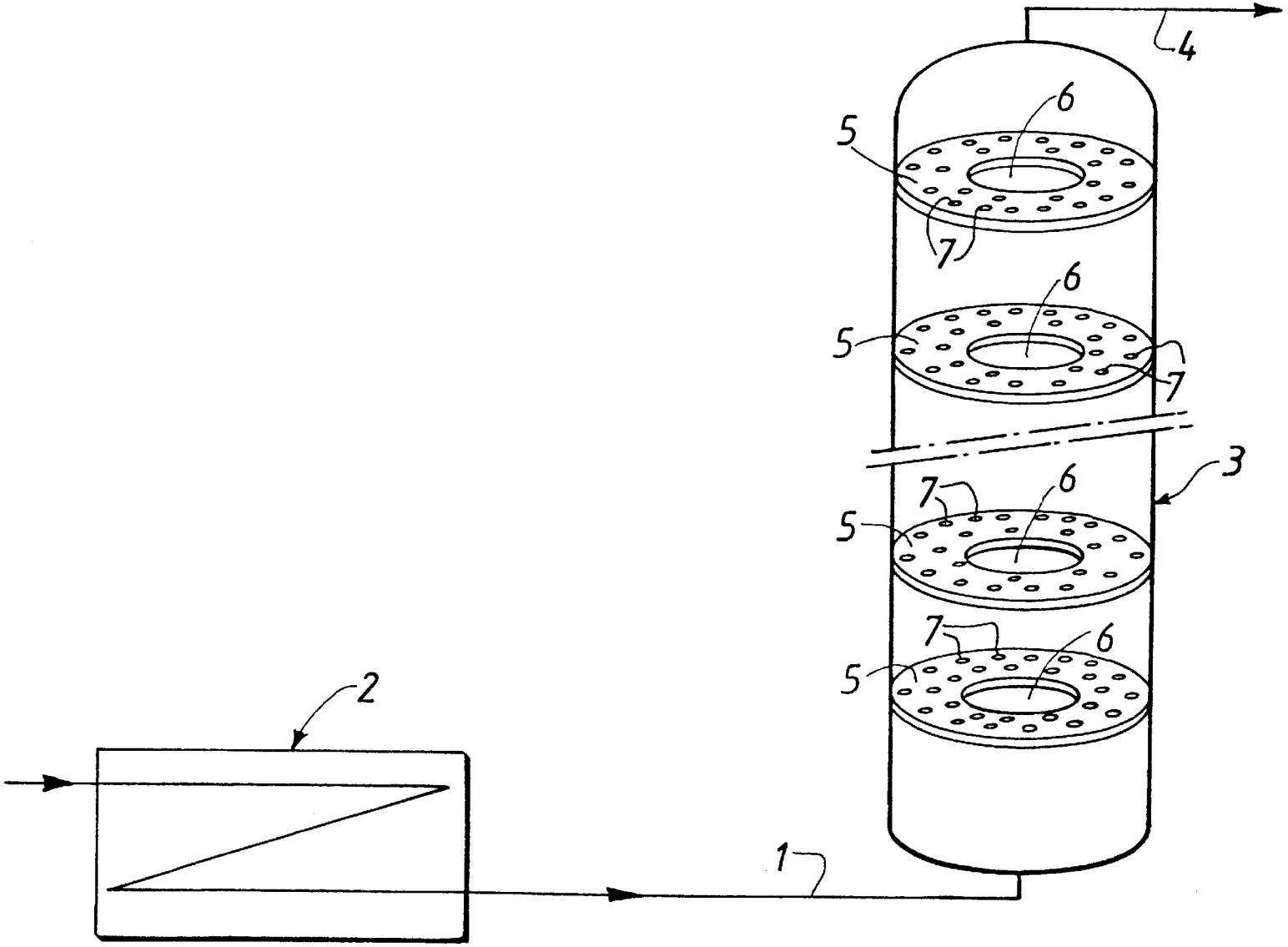
4
3
6
7
5
1
2

METHODS AND APPARATUS FOR THE VISCOSITY REDUCTION OF HEAVY HYDROCARBON FEEDSTOCKS

RELATED APPLICATION

This application claims priority to French Application No. 95.14313, filed Dec. 4, 1995, incorporated herein by reference.

FIELD OF THE INVENTION

The present invention is related to improvements to methods and apparatus for the visbreaking of heavy hydrocarbon feedstock.

BACKGROUND OF THE INVENTION

It is known that by visbreaking is meant a treatment of heavy hydrocarbon feedstocks which comprises placing said feedstocks in the liquid state into a furnace at a temperature sufficient to cause the heaviest hydrocarbons to crack and then introducing them into a maturation device (known in the art as a "soaker") wherein, without additional heating, they travel at a rate such that at the prevailing temperature they have a sufficient residence time for achieving the desired cracking of the heavy molecules into lighter molecules. The cracking results in a reduction in viscosity of the treated feedstock. This process is known as visbreaking (a term of art used as an abbreviation for "viscosity reduction"), and the apparatus used is known as a visbreaker.

The soaker usually has the form of a cylindrical enclosure which is not provided with additional means for heating the feedstock and in which, because cracking is endothermic, the feedstock temperature drops a few tens of degrees between the time the feedstock enters the soaker and the time it exits. The temperature in the soaker is generally about 400°–500° C. an the pressure about 2 to $30\times10^5$ pascal. The residence time of the feedstock in the soaker is about 10–30 minutes. The severity, which is a function of the residence time and the soaker temperature, is of the order of 20 minutes.

The feedstock to be treated is injected at the bottom of the soaker, whereas the cracked product, including any gaseous products that may have formed, is discharged at the top and is directed to a fractionation unit for atmospheric distillation followed by vacuum distillation.

The feedstock to be treated can be a heavy petroleum crude, an atmospheric distillation residue, used only rarely because there are other ways of utilizing it, a vacuum distillation residue or a deasphalting pitch.

After fractionation, the visbroken products consist of gaseous hydrocarbons, liquefied petroleum gas, gasoline, gas oil, distillate and visbroken vacuum residue.

The visbroken vacuum residue is the last recoverable product and, to be used as fuel oil base, must meet stringent requirements of stability and compatibility with other petroleum fractions. Hence, to meet these requirements, the operator must adjust the visbreaking conditions, particularly the temperature.

A major problem encountered in visbreaking units lies in the non-homogeneous progression of the charge stock inside the soaker and in back-mixing and vortexing, occurring particularly in the vicinity of the side walls and at the bottom of the soaker. These disturbances are aggravated by the gases generated by the cracking reactions and by the fact that the residence time of the feedstock in the soaker varies markedly in the same cross-section, depending on the zone considered. As a result, there is a risk that part of the treated feedstock will be overcracked, while another fraction will be insufficiently cracked.

To eliminate this drawback, it was suggested in EP-A-007 656 to dispose inside the soaker, transversely to the direction of feedstock flow, a plurality of internal structures [often referred to in the art as "internals"]. These consist of perforated plates, the orifices in said plates being circular and/or having the shape of slots, said orifices preferably constituting from 1 to 30%. of the plate surface area.

Thus, at the level of the plate orifices which are traversed by the gas bubbles present, each plate causes mixing of the feedstock. The aforecited European Patent Application recommends that from 1 to 20 plates of this type be used in a soaker.

As is indicated in EP-A-0 138 247 (and in equivalent U.S. Pat. No. 4,551,233 issued Dec. 5, 1985), the stability of the cracked products is still inadequate when one uses perforated plates of this type, especially when large quantities of gaseous compounds are formed together with substantial quantities of coke during use, such that there is a serious risk of plugging the plate perforations. This blockage results in long and expensive down times for the soaker, when the perforated plates are cleaned and the coke that is present is removed.

OBJECTS OF THE INVENTION

It is an object of the present invention to avoid these disadvantages by providing means that will ensure a more homogeneous residence time of the feedstock in the soaker, resulting in increased stability of the viscosity reduced product obtained as well as an increased rate of conversion for the products obtained by visbreaking.

Another object of the invention is to limit the back mixing phenomena associated with the treatment of heavy hydrocarbon feedstock in the soaker of a visbreaking unit.

A further object of the invention is to reduce the formation of coke in visbreaking methods and apparatuses.

SUMMARY OF THE INVENTION

The applicants have discovered that, by arranging annular discs in the soakers transversely with respect to the direction of the treated feedstock, said annular discs being spaced from one another and their edges abutting or otherwise in contact with the inner faces of the side walls of the soaker, a more substantial conversion of the feedstock, and consequently, a substantial reduction in the coke formed and a better stability of the vacuum viscosity reduced residue is simultaneously obtained.

A preferred embodiment of the present invention concerns a method for the visbreaking of a heavy hydrocarbon feedstock in the liquid state, wherein said feedstock is brought to a temperature capable of cracking at least a portion of the hydrocarbons present. The feedback is then introduced into the lower part of a soaker, is displaced from the base of the soaker upwards, and is then evacuated from the upper portion of the soaker towards a fractioning unit. Within the soaker a plurality of annular discs spaced from one another are provided, transversely to the direction of the feedstock being treated, each disc comprising a central circular passage substantially coaxial to the soaker. The treated feedstock circulates from the base upwards in the soaker by following the central passages of the various annular discs.

By requiring the feedstock to undergo a bottom to top displacement along the axis of the soaker, the main effect of the annular discs is to limit the radial dispersion of the feedstock.

Advantageously, the outer edges of the annular discs abut with the inner contiguous surfaces of the side walls of the soaker.

Preferably, in the case of a cylindrical soaker having an axial length of 8 meters to 14 meters and a diameter of between 1.5 and 2.5 meters, 3 to 10 uniformly spaced annular discs are arranged between the base and the upper part of the soaker.

Advantageously, the central passage of each annular disc represents at least 30% of the annular disc surface and preferably 30 to 65% of such surface.

In order to avoid the creation of dead zones between the annular discs, such discs are preferably perforated, the perforations thus provided in the discs being distributed in a substantially uniform manner over the surfaces of the respective discs and occupying between approximately 5 and 30% of the annular surface. The openings have a diameter large enough to avoid potential carbonization, which runs the risk of blocking said holes. In particular, their diameter is at least 30 millimeters and preferably comprised between 30 and 100 millimeters.

Preferably, the openings of the contiguous perforated annular discs are offset laterally with respect to one another so as to avoid a seepage phenomenon, which could occur if the openings of the consecutive discs were arranged directly opposite one another.

The invention also naturally concerns an apparatus for the visbreaking of heavy hydrocarbon feedstock in the liquid state, said device being of the type comprising a means for heating the feedstock up to the temperature capable of the cracking of at least a portion of the hydrocarbons, and a soaker comprising, at its lower portion, at least one feed line for the preheated feedstock, and at its upper portion, at least one line for evacuating the treated feedstock towards a unit for fractioning said feedstock, wherein within the soaker are arranged a plurality of annular discs spaced from one another, mounted transversely to the direction of displacement of the feedstock to be treated, the edges of the discs preferably abutting the inner contiguous surfaces of the side walls of the soaker, and each of said discs comprising a circular central passage that is substantially coaxial to the soaker.

BRIEF DESCRIPTION OF THE DRAWING

In this specification and in the accompanying drawing, we have shown and described preferred embodiments of our invention and have suggested various alternatives and modifications thereof; but it is to be understood that these are not intended to be exhaustive and that many other changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

FIG. 1, the only drawing in this application, is a schematic view of a visbreaking apparatus according to the present invention.

DETAILED DESCRIPTION OF PREFERRED EMBODIMENTS OF THE INVENTION

FIG. 1 shows the usual elements of a visbreaking unit, namely line 1 for feeding the heavy hydrocarbon feedstock to be treated in the liquid state;

furnace 2 through which passes line 1 and which preheats the heavy feedstock to an appropriate temperature to ensure the cracking of at least part of the hydrocarbons it contains;

soaker 3, in the form of a vertically-disposed closed cylindrical vessel, fed at its base by line 1 and equipped in its upper part by a line 4 for evacuating the cracked products of the feedstock towards a fractioning unit.

In accordance with the invention, annular discs 5 comprising a central circular passage 6 are located within the soaker 3 perpendicular to its axis. These discs 5, of which there are eight, for example, in a soaker that is 12 meters in height, are spaced in a substantially uniform manner with respect to one another, from the base through the upper part of soaker 3. The edges of the discs 5 are in contact with the inner surface of the side walls of the soaker 3. The circular passages 6 represent at least 35% of the annular disc surface.

Each disc 5, the illustrated preferred embodiment, is also crossed by perforations 7 forming openings that are uniformly spaced over its surface. These openings provide additional passages for the treated feedstock, including any gases that were formed and/or injected, transversely to the disc, and thereby avoid the formation of "dead zones" between contiguous discs. Openings 7 of contiguous discs are not located directly across from one another, but rather are offset in an angular manner with respect to each other so as to avoid seepage phenomena. The perforations preferably occupy approximately 30%. of the annular surface area of the disks 5, over which they are uniformly distributed. As shown in the drawing, the central passage 6 is several times larger than the perforations 7 (for example, the diameter of perforations 7 preferably range from 0.03 m to 0.1 m, while the diameter of central passage 6 preferably range from 0.72 m to 1.2 m; i.e. about seven to twelve times greater).

Under similar treatment conditions, the annular discs of the invention enable one to obtain a visbreaker vacuum residue with a greatly improved stability, as will be apparent from the examples below.

It is known, in fact, that the operation of a visbreaker unit is guided by taking the stability of the visbreaker residue as a reference criterion for the use of said residue as fuel, because if the stability is not above a certain threshold, the fuel could, during use, present problems induced by the formation of sediments resulting from the precipitation of asphaltenes.

It is possible to envision a number of variations of the device as per the invention, without leaving the scope of the application.

In particular, in the case of one such alternate embodiment, a central shaft detachable from the top of the soaker penetrates therein via the central passages of the annular discs.

In addition, this shaft bears additional "internals", spaced from one another, whose transverse surface is such that these "internals" can pass through the central passages of the discs so as to be able to be detached, but is greater than 5% of the transverse surface of the soaker.

These additional "internals" are, for example, whole discs, possibly perforated. The various "internals" can be arranged such that the whole discs and the annular discs alternate. Each whole disc is, for example, positioned at a distance comprised between a third and two thirds of the distance separating the two consecutive annular discs, and preferably half way between such discs.

EXAMPLES

The following comparative examples prove that the vacuum viscosity reduced residue obtained by the method as per the invention has improved stability. In addition, the examples also illustrate the advantages of this method.

EXAMPLE 1

This example illustrates a normal visbreaking cracking method, without using the annular discs as per the invention in the soaker, of a vacuum distillation residue having the following characteristics:

| | |
|---|---|
| density: | 1.0375 |
| viscosity ($10^{-6}$ $m^2/s$ to 100° C.): | 3500 |
| sulfur content (% by weight): | 3.86 |
| Conradson carbon content (% by weight): | 19.6 |
| asphaltene content (% by weight): | 12.1 |
| fraction point (°C.): | 520° C. |

This vacuum residue is heated to a temperature of approximately 440° C. in a furnace of a visbreaking unit and is then introduced into a visbreaking soaker, which has not been modified as per the instant invention. This soaker has a diameter of 2.5 meters and a height of 14 meters.

The operational temperature is 425° C. and the operational pressure is $8\times10^5$ Pascals. The feedstock output is 100 metric tons/hour and the average residence time is 18 minutes. Upon exiting the soaker, the visbreaking effluent is fractioned in an atmospheric distillation column and then in a vacuum distillation column. The products obtained after fractioning and their quantities are in indicated in Table 1 below.

EXAMPLE 2

The same vacuum distillation residue is once again subjected to a visbreaking method, under identical severity conditions. The feedstock is heated in the furnace to a temperature of approximately 440° C., and the operational temperature and pressure conditions in the soaker are 425° C. and $8\times10^5$ Pascals respectively. The feedstock output remains the same as previously described in Example 1.

The soaker has been modified as per the invention and comprises six annular discs, separated from one another by a distance of 2 meters, the lowest disc being located at 2.5 meters from the base. These discs are made of steel and have a thickness of 3 millimeters. They are located coaxially with respect to the soaker and they each comprise a central circular passage of a diameter of 1.5 meters and openings having a diameter of 90 millimeters are distributed uniformly over their surface. The six discs are identical and offset angularly at 20°, such that the openings of two contiguous discs are not arranged directly across from each other.

As previously described in Example 1, upon exiting the soaker, the viscosity reduced effluent is fractioned in an atmospheric distillation column, and then in a vacuum distillation column. The nature of the products obtained and the respective quantities are indicated in Table 1 below.

EXAMPLE 3

With the same vacuum distillation residue as in Example 1, a visbreaking treatment is carried out under heightened severity conditions with respect to Examples 1 and 2.

The residue is heated in the furnace to 448° C. and is then introduced in the soaker equipped with six annular discs identical to those employed in Example 2. The soaker is maintained at a temperature of 434° C. The pressure conditions as well as the feedstock output and the average residence time in the soaker are the same as described in Examples 1 and 2.

The method is thus carried out under more heightened severity conditions than in Examples 1 and 2.

As in these examples, the flow of the soaker is fractioned in an atmospheric distillation column, and then in a vacuum distillation column.

The products obtained are listed in Table 1 below.

TABLE 1

| Products Obtained After Fractionation, (wt %) | Example 1 | Example 2 | Example 3 |
|---|---|---|---|
| Gas | 0.64 | 0.50 | 0.55 |
| Gasoline + LPG | 5.00 | 5.50 | 5.80 |
| Gas oil (Diesel) | 12.30 | 13.70 | 14.70 |
| Distillate | 10.90 | 11.10 | 11.75 |
| R. S. V. R. (vacuum residue) | 71.20 | 69.2 | 67.20 |
| Stability of R. S. V. R. | | | |
| stability* | + | ++ | + |
| sediments (**), ppm | 850 | 500 | 800 |
| Viscosity of R. S. V. R. (cst at 100° C.) | 40,000 | 63,000 | 102,000 |

(*)Measured, for example, by ASTM test method D 1661 (ASTM Standards, pages 657–661, Vol. 05.01, 1989 edition).
(**) Measured by French test method NFM 07063. The filtration temperature was adapted to the product and was above 100° C. An additional washing with a solvent suitable for the filtration temperature used was carried out before washing with dodecane.

It can be seen that the quantities of gas and vacuum residue that are obtained with the soaker as per the invention of Example 2 are lower than those obtained with the soaker using prior art technology (Example 1) and that the quantities of gasoline and distillate are greater. One can especially see a very substantial increase in the quantity of diesel fuel.

The viscosity of the vacuum viscosity reduced residue (R.S.V.R.) of Example 2 (method as per the invention) is higher than that of the vacuum residue obtained according to the prior art method. In addition, stability is better for the residue resulting from the treatment of the soaker according to the invention.

For example 3, the conversion is improved even more and is translated by an increase in the quantities of gasoline, distillate and diesel fuel. The viscosity of the vacuum residue increases substantially with respect to Examples 1 and 2 and its stability is identical to that of Example 1, despite the more severe visbreaking conditions.

These results thus clearly indicate the advantages of the method as per the invention.

We claim:

1. A visbreaking method for a liquid heavy hydrocarbon feedstock comprising the steps of bringing said feedstock to a temperature capable of cracking at least a portion of the hydrocarbons present in said feedstock, introducing said feedstock into a lower portion of a maturation zone, flowing said feedstock and products produced therefrom from the lower portion to an upper portion of said maturation zone, discharging the resulting products from the upper portion of said maturation zone, said maturation zone containing a plurality of annular discs mounted transversely to the direction of flow displacement of the feedstock in said zone with each disc being spaced apart from one another and having a circular central passage substantially coaxial to a longitudinal axis of said maturation zone through which central passage flows the greatest portion of the feedstock and its products, which portion is several times any other portion flowing through any other non-central passage across such discs.

2. The method of claim 1, wherein the outer edges of said annular discs abut inner contiguous surfaces of the walls defining the maturation zone.

3. The method of one claim 2, wherein the annular discs define separate volumes within said maturation zone, and wherein the feedstock and any gases formed which are contained within the respective separate volumes are also in contact with one another by means of additional openings present in said annular discs.

4. An apparatus for visbreaking liquid heavy hydrocarbon feedstock, comprising a feedstock heater capable of attaining a temperature effective to crack at least a portion of the hydrocarbons in such feedstock, an elongated soaker vessel with side walls, at least one feed line for conveying the preheated feedstock from said heater to the lower portion of said vessel, at least one discharge line from the upper portion of said vessel for evacuating the treated feedstock towards a fractioning unit, a plurality of annular discs, spaced apart from one another, mounted transversely to the axial length of said vessel, and each disc having a central circular passage substantially coaxial to the vessel, which passage is several times larger than any other passage across such disc.

5. The apparatus of claim 4, wherein the edges of said discs abut the side walls of the soaker vessel.

6. The apparatus of claim 5, wherein said annular discs are uniformly spaced apart from one another.

7. The apparatus of claim 4, wherein the area defined by said circular passage of said discs is at least 30% of the annular area of such discs.

8. The apparatus of claim 6, wherein the area defined by said circular passage of said discs is between 30 and 65% of the annular area of such discs.

9. The apparatus of claim 4, wherein said annular discs are perforated with openings.

10. The apparatus of claim 8, wherein said annular discs are perforated with openings.

11. The apparatus of claim 9, wherein said perforated openings are uniformly and identically distributed over the surface of each annular disc.

12. The apparatus of claim 10, wherein said perforated openings are uniformly and identically distributed over the surface of each annular disc.

13. The apparatus of claim 9, wherein said perforated openings in each annular disc occupy between approximately 5 and 30% of the annular surface of each such disc.

14. The apparatus of claim 12, wherein said perforated openings in each annular disc occupy between approximately 5 and 30% of the annular surface of each such disc.

15. The apparatus of claim 13, wherein each of said perforated openings has a diameter of between 30 and 100 mm.

16. The apparatus of claim 14, wherein each of said perforated openings has a diameter of between 30 and 100 mm.

17. The apparatus of claim 9, wherein the corresponding perforated openings of contiguous discs are offset laterally with respect to one another.

18. The apparatus of claim 14, wherein the corresponding perforated openings of contiguous discs are offset laterally with respect to one another.

19. The apparatus of claim 4, wherein said soaker has an axial length of between 8 and 14 meters and a diameter of between 1.5 and 2.5 meters, and wherein said soaker has between 3 and 10 annular discs.

20. The apparatus of claim 18, wherein said soaker has an axial length of between 8 and 14 meters and a diameter of between 1.5 and 2.5 meters, and wherein said soaker has between 3 and 10 annular discs.

21. The apparatus of claim 10, further comprising a central shaft coaxially aligned with the central passages; a plurality of discs mounted transversely on and spaced along said shaft alternating with said annular discs, positioned at a distance between a third and two thirds of the axial distance separating any two consecutive annular discs, and being dimensioned to be capable of passing through said central passages and having a transverse surface greater than 5% of the transverse surface of the soaker.

22. The method of claim 1, wherein the area defined by said circular passage of said discs is at least 30% of the annular area of such discs.

23. The method of claim 1, wherein at least 50% of the upward flow of the feedstock and its products passes through the central passages.

* * * * *